US005706771A

United States Patent [19]

Van Heyningen et al.

[11] Patent Number: 5,706,771

[45] Date of Patent: Jan. 13, 1998

[54] HYDRAULIC ELEMENT ASSEMBLY

[75] Inventors: Paul Robert Van Heyningen, Fairport; Oscar Alfredo Estratti, Rochester; Michael Edward Mc Carroll, W. Henrietta; Antonio St. Clair Lloyd Williams, Rochester; Daniel Patrick O 'Neill, Freeport, all of N.Y.; Donald R. Smith, Lowell, Mich.; John Joseph Burns, Geneva, N.Y.

[73] Assignee: General Motors Corporation, Detroit, Mich.

[21] Appl. No.: 773,238

[22] Filed: Dec. 23, 1996

[51] Int. Cl.[6] ..... F01L 1/18; F01L 1/24

[52] U.S. Cl. ..... 123/90.46; 123/90.55

[58] Field of Search ..... 123/90.39, 90.45, 123/90.46, 90.47, 90.49, 90.52, 90.55

[56] References Cited

U.S. PATENT DOCUMENTS

| | | | |
|---|---|---|---|
| 4,570,582 | 2/1986 | Speil | 123/90.46 |
| 4,708,103 | 11/1987 | Speil | 123/90.46 |
| 4,724,805 | 2/1988 | Wirth et al. | 123/90.39 |
| 4,856,468 | 8/1989 | Speil et al. | 123/90.46 |
| 5,609,133 | 3/1997 | Hakansson | 123/90.46 |
| 5,632,237 | 5/1997 | Cornell et al. | 123/90.46 |

*Primary Examiner*—Weilun Lo
*Attorney, Agent, or Firm*—Karl F. Barr, Jr.

[57] ABSTRACT

A valve actuation assembly for an internal combustion engine is disclosed in which a rotatable rocker arm assembly is actuated by an engine driven camshaft to move a poppet valve reciprocably. The rocker arm assembly includes a hydraulic lash adjuster for disposition between the rocker arm and the valve stem. The lash adjuster includes an actuator at one end having an axially extending neck which terminates in an enlarged head. The enlarged head engages a foot assembly which includes a disk having a socket in which the head is positioned. A retainer ring is disposed in the socket and includes a wall portion which operates to establish an interference fit with the socket so as to fix the ring in the socket and a radially inwardly extending flange member which operates to define an opening through which the actuator neck extends but having a diameter less than that of the enlarged head portion of the actuator to thereby prevent removal of the head from the socket.

3 Claims, 3 Drawing Sheets

HYDRAULIC ELEMENT ASSEMBLY

TECHNICAL FIELD

The invention relates to hydraulic lash adjusters for internal combustion engines.

BACKGROUND OF THE INVENTION

The desirability of reducing frictional loss at the interface between the rocker arm and the stem end of an associated poppet valve member while minimizing lash between such valve components during the operation of an internal combustion engine is recognized. One proposed solution to such problem as disclosed, for example, in U.S. Pat. No. 4,708,103 issued Nov. 24, 1987 to Walter Speil, is by the use of a hydraulic lash adjuster operatively positioned in the valve actuator arm portion of a rocker arm. The follower body of the lash adjuster has a semi-spherical, closed end that is operatively associated with a separate semi-spherical socket provided in one side of a disc shaped, foot member. The opposite surface of the foot member is configured with a flat surface so as to engage the upper flat free stem end of an engine valve. A cage member engages, and extends downwardly from, the exterior of the follower body of the lash adjuster to engage the outer surface of the foot member with a radially inwardly directed flange which is operable to retain the foot member in association with the semi-spherical end of the follower body. In such a valve train arrangement, the cage member, located externally of the follower body, is subject to external influences which may inflict damage. Such external influence may include contact between the foot member and the cage, when the components are at maximum relative angles. Such contact may present the cage member as the defining component for maximum swing angle resulting in the potential for accelerated wear or component fatigue. Additionally, the external mounting of the cage member to the follower body may act to interfere with the flow of lubricating oil along the outer follower body surface and to the interface of the spherical projection and the foot member.

SUMMARY OF THE INVENTION

The present invention relates to a hydraulic lash adjuster of the type which may be mounted within a rocker arm and includes a ball and socket assembly interposed between the follower body and the valve stem. A primary object of the invention is to provide an improved hydraulic lash adjuster wherein the body of the lash adjuster includes a semi-spherical or semi spheroidal actuator end that is in substantial rolling contact within a socket provided in a foot member. The foot member includes a retainer assembly, as a portion of the socket, which operates to retain the foot member in engagement with the actuator end of the body.

Location of the retainer assembly within the socket portion of the foot operates to protect the retainer during assembly and operation of the engine as well as to define a subassembly which is capable of functional testing prior to final assembly.

It is a further object of the present invention to provide a hydraulic lash adjuster having improved lubrication at the interface of the lash adjuster body with the socket of the foot member. External cages, of the type disclosed above, operate to interfere with the flow of lubricating oil along the outer surface of the body and, subsequently to the semi-spherical actuator. By locating the retainer assembly within the socket portion of the foot member a lubrication flow path is defined.

In one preferred embodiment of the present invention, the foot member retainer assembly utilizes an interference fit along a portion of the inner diameter wall of the foot socket. Such method of assembly allows the retainer and the foot geometries to be constructed in as-formed condition with no, or minimal further machining steps required to implement the retainer function.

In a preferred embodiment of the invention, the retainer assembly is configured and assembled to the foot member so as to provide a desired angular rotation, or swing angle, of the foot relative to the follower body while avoiding contact with the body. Absence of contact between the retainer assembly and the body limits retainer wear and fatigue.

The details, as well as other features and advantages of the invention are set forth in the following detailed description and drawings.

DESCRIPTION OF THE PREFERRED EMBODIMENT

Figure 1:
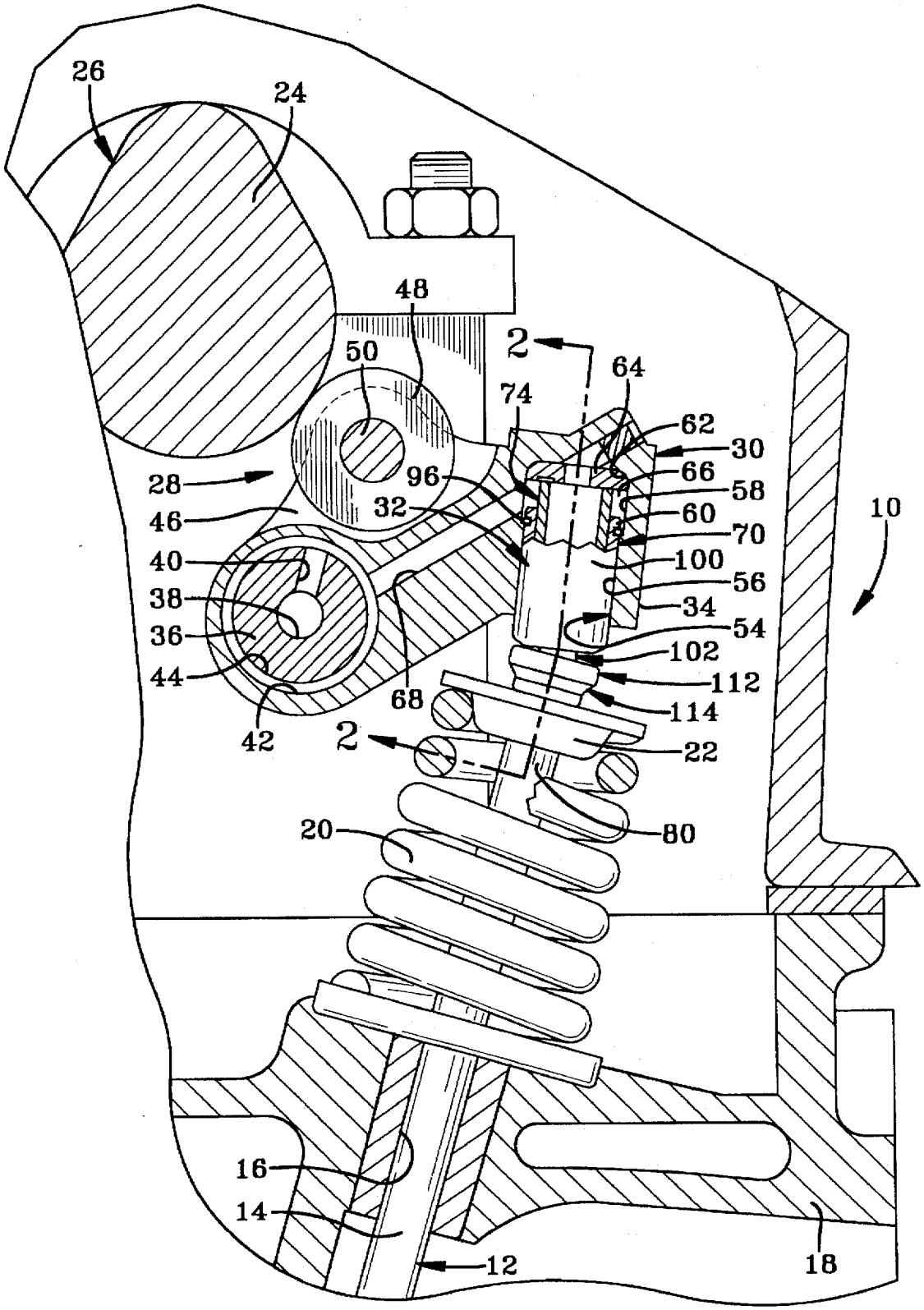
FIG. 1 is a partial, sectional view of an internal combustion engine which embodies features of the present invention.

Referring to FIG. 1, there is shown a portion of an internal combustion engine, designated generally as 10, which includes a poppet valve 12 having a stem 14, supported in guide bore 16 in cylinder head 18. Valve 12 moves reciprocally to open or close a port, not shown, which can be either an inlet or an exhaust port. The stem 14 of the popper valve 12 is normally biased to a valve closed position by a valve return spring 20 disposed coaxially about the stem 14. One end of the return spring 20 is supported by an upper surface of the cylinder head 18 while the opposite end of the spring 20 engages a suitable retainer 22 fixed, in a conventional manner, to the stem.

Figure 2:
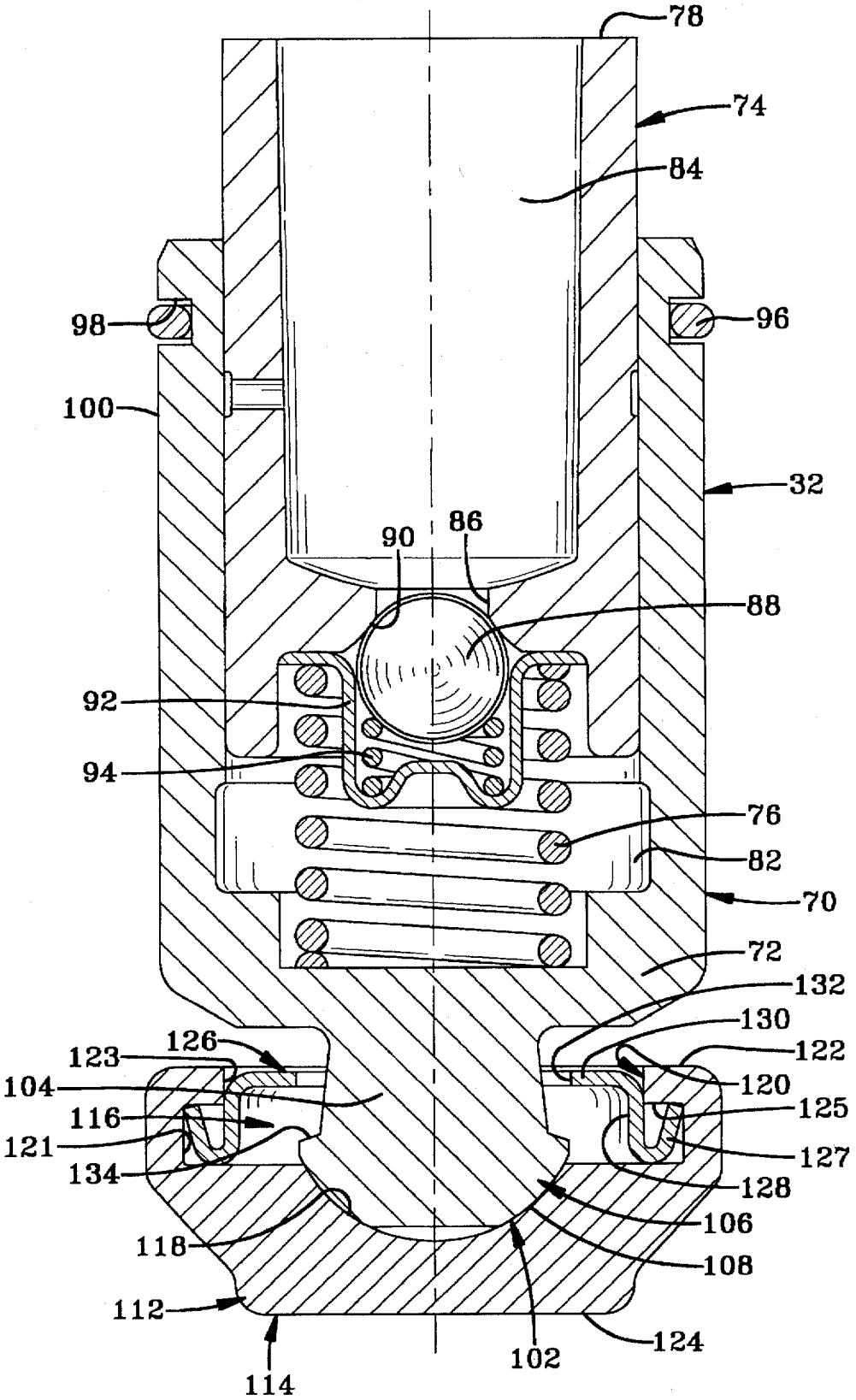
FIG. 2 is a sectional view of the hydraulic lash adjuster illustrated in the engine of FIG. 1, taken along line 2—2.

The stem 14 of the poppet valve 12 is operated on by a cam 24 on a camshaft 26 via a rocker arm assembly 28. The rocker arm 30 of rocker arm assembly 28 is rotatably supported above the cylinder head 18 on a rocker shaft 36 and includes a valve actuator arm 34 which overlies the stem 14 of the poppet valve 12. A hydraulic lash adjuster 32, FIG. 2, is received within a stepped bore 54 in the valve actuator arm 34 and operates as an interface between the valve stem end 80 and the rocker arm assembly 28 to take up lash therebetween.

The rocker shaft 36 is supported above the cylinder head and includes an axially extending bore 38 which is in continuous communication with pressurized lubricant supplied by the engine 10. The rocker shaft 36 is provided with at least one rise passage 40 for each rocker arm 30 that communicates with an annular groove 42 provided in either the outer peripheral surface of the rocker shaft 36 or, as shown, in the inner peripheral surface of the bore 44 of the rocker arm 30.

In the construction illustrated, the cam actuated rocker arm 30 is bifurcated intermediate of its ends to define spaced apart roller supports 46, so as to loosely receive a cam follower roller 48 rotationally supported on a shaft 50 fixed in and extending through suitable apertures provided for this purpose in the roller supports 46.

Rocker arm 30 is provided with a stepped bore 54 so as to define in succession, starting from the lower end as viewed in FIG. 1, a cylindrical follower body guide wall 56 and an upper wall 58. The follower body guide wall 56 is of a diameter less than that of the upper wall 58 and is connected to the upper wall by a shoulder 60.

The upper end 62 of the stepped bore 54 is substantially closed by means of a disc 64 that is positioned within the upper wall portion 58 in abutment with the upper end 62. The lower surface of the disc 64 forms, with the upper wall 58, a fluid reservoir 66 which is in flow communication via a passage 68 which extends from the upper wall 58 through the rocker arm 30 to intersect groove 42 and establish fluid communication with the engine lubricant supply in the rocker shaft 36.

Figure 3:
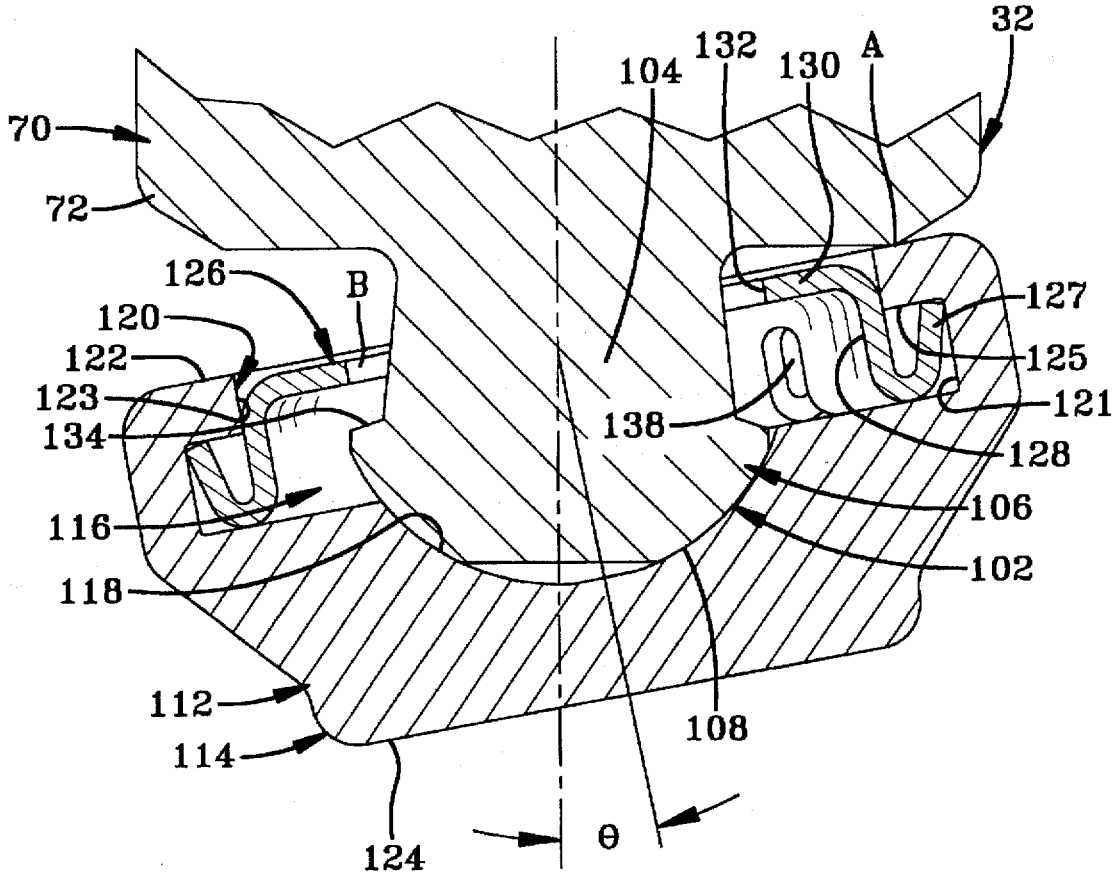
FIG. 3 is an enlarged view of a portion of the hydraulic lash adjuster illustrated in FIG. 2.
Figure 4:
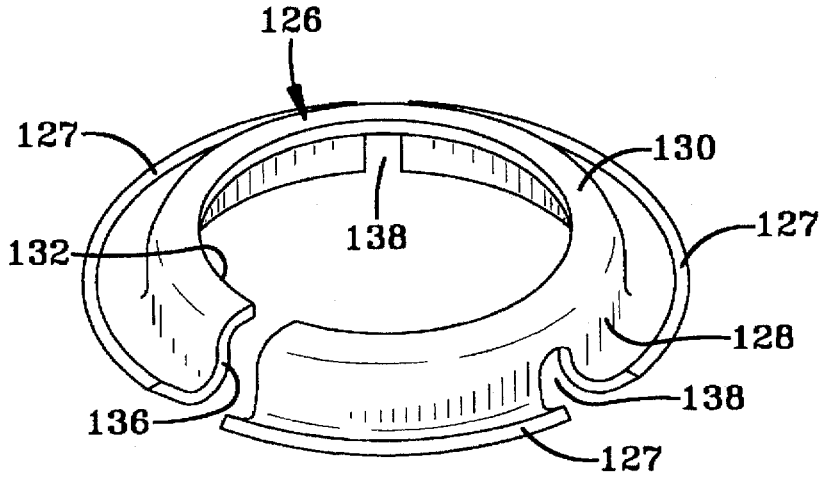
FIG. 4 is a perspective view of a retainer ring used in the hydraulic lash adjuster of FIG. 2.

The hydraulic lash adjuster 32, shown in detail in FIGS. 2, 3 and 4, except for the specific construction of the closed end of the follower body 70, is of substantially conventional construction and includes a cup shaped, cylindrical follower body 70, having a closed end 72, that is slideably received in the follower guide wall 56 of the stepped bore 54. A plunger or piston 74 is disposed within the cylindrical follower body 70 for reciprocation therein, and is normally biased upwardly by a plunger spring 76 so that its upper end 78 abuts against the lower surface of the disc 64. The plunger spring 76 also acts against the closed end 72 of the follower body 70 so as to maintain the closed end of the hydraulic lash adjuster 32 in operative engagement with the terminal end 80 of the popper valve stem 14.

The lower end of the plunger 74 forms, with the closed end 72 of the follower body 70, a pressure chamber 82 while the upper, open end of the plunger 74 defines a supply chamber 84 that is in continuous flow communication with the fluid reservoir 66. The supply chamber 84 is in flow communication with the pressure chamber 82 via a port 86, flow though which is controlled by a one-way valve in the form of a ball 88 which closes against a seat 90 disposed about the port 86.

A suitable valve cage 92 and valve return spring 94 limits open travel of the valve ball 88 to that necessary to accommodate replenishment of the pressure chamber 82 with oil which normally escapes therefrom between the sliding surfaces of the plunger 74 and the follower body 70 as "leakdown" during cam induced opening movements of the stem 14 of the poppet valve 12. The valve cage 92 is held in position against the plunger 74 by the plunger spring 76, or alternatively, the valve cage 92 may be held as by an interference fit to the plunger 74.

The hydraulic lash adjuster 32 is axially retained, for limited movement within the stepped bore 54 by means of a retainer ring 96 located in annular groove 98, provided for this purpose, in the outer peripheral surface 100 of the follower body 70, whereby the retainer ring 96 registers with the shoulder 60 to thereby limit the downward travel of the follower body 70, as viewed in FIG. 1.

In the embodiment shown in FIGS. 2–4, the follower body 70 of the hydraulic lash adjuster 32 has its closed end provided with a depending actuator 102 that includes an axially extending neck portion 104 terminated, at its lower end, with an enlarged diameter actuating head 106 which includes a semi-spherical or semi-spheroidal actuating surface 108.

Foot assembly 112 is in the form of a circular disc 114 having, on one side thereof, a socket 116 defined by a semispherical lower surface 118 having radii which are complementary to the radii of the actuating surface 108 of the actuating head 106 of the follower body 70. Surrounding the semispherical lower surface of the socket 116 is an axially extending, stepped cylindrical wall 120 which terminates in an annular land 122 defining the upper surface of the disc 114. The stepped cylindrical wall 120 defines in succession, starting from the lower end as viewed in FIG. 2, an undercut wall 121 and a retainer guide wall 123. The undercut wall 121 is of a diameter greater than that of the retainer guide wall 123 and is connected to the retainer guide wall 123 by a shoulder 125. A flat surface comprises the second, lower surface 124 of the circular disc 114 and is configured for contact with the terminal end 80 of the valve stem 14 of popper valve 12.

Foot assembly 112 also includes a retainer ring 126 which is located in the socket 116 formed in the disc 114. The retainer ring 126, FIG. 4, is configured as a substantially annular ring having a cylindrical wall 128 which extends upwardly to terminate in a radially inwardly extending flange 130 which defines an opening 132 therein. The cylindrical wall 128 is of an axial length which allows the retainer ring to be inserted into the socket 116 of the disc 114 such that the top surface of the radial flange 130 is located at or below the surface of the land 122. An interference fit is established between the retaining ring 126 and the stepped cylindrical wall 120 of the socket 116 to define a foot retainer assembly which can subsequently be snapped over the enlarged diameter actuating head 106 such that the opening 132 in the retainer ring 126 defined by the radially inwardly extending flange 130 loosely encircles the neck portion 104 of the actuator 102. Movement of the foot assembly 112 off of the actuator 102 is prevented by contact between the radially inwardly extending flange 130 and the back 134 of the enlarged diameter actuating head 106 as the opening 132, defined by the flange 130, is of a diameter smaller than that of the head 106.

In the embodiment of the retainer ring 126, shown in detail in FIG. 4, the cylindrical wall 128 includes an upwardly turned annulus 127 extending about its lower axial end opposite the radially inwardly extending flange 130. In addition, a slot 136 is provided in the ring which allows radial compression during installation of the ring into socket 116. Once installed in socket 116, the ring 126, preferably constructed of a material having a high modulus of elasticity, such as spring steel, is biased towards its original configuration to urge the upwardly turned annulus 127 into the undercut wall portion 121 of the cylindrical wall 120, thereby establishing an interference fit with the cylindrical wall 120 of the socket 116. The annulus 127 prevents the retainer ring 126 from moving axially out of the foot socket 116 though engagement with the shoulder 125 between he undercut wall 125 and the retainer guide wall.

As the foot assembly 112 is pushed onto the actuator 102, the slot 136 permits the radially inwardly extending flange 130 of the retainer ring 126 to deflect, thereby allowing the enlarged diameter actuating head 106 to clear the opening 132, following which the flange returns to its predeflected state, trapping the head 106 within the socket 116 of the foot assembly 112.

The retainer 126 may also include one or more slotted openings 138 at spaced intervals about the perimeter thereof. The slotted openings 138 facilitate inward flexation of the cylindrical wall 128, during installation of the retainer 126 into the foot 126 thereby minimizing the force required to push the upwardly turned annulus 127 past the retainer guide wall 123 and into engagement with the undercut wall 121.

The embodiments of retainer-foot assemblies disclosed above may allow the disc 114 to be manufactured using methods such as cold forming with the cylindrical wall 120 as a net formed feature which requires no secondary operations prior to insertion of the retainer ring 126 into the foot socket 116. The use of such an interference or mechanically locking fit between the retainer ring 126, and the socket 116 eliminates secondary staking or rolling type operations to fix the retainer ring to the foot.

Lubrication of the surface 118 defining the socket 116 and the corresponding surface 108 of the enlarged actuator head 106 is by oil leakage primarily from between the guide wall 56 and the outer peripheral surface 100 of the follower body 70 or, by splash lubrication in a manner well known in the art. Location of the retaining ring 126 within the socket 116 of the disc 114 provides a distinct advantage in lubricating this interface as it provides an unobstructed flow path for lubricating oil to flow along the outer surface of the follower body 70 including the neck 104, and into the socket 116.

Operation of the internal combustion engine 10 will result in pivotal movement of the rocker arm 30 from a valve closed position to a valve open position. The effective operative contact point between an associate element of the valve actuator arm and the terminal end 80 of the valve stem 14 will move laterally across the stem terminal surface 15. The foot assembly 112, being loosely disposed about the neck 104 of the actuating head 106 of the follower body 70, allows for pivotal movement between the complementary semispheroidal surfaces of the foot socket 116 and the actuator 106 allowing for relative angular movement between the lash adjuster body 70 and the foot assembly 112 to thereby reduce scrubbing engagement between the lash adjuster 32 and the valve stem 14. With the retaining ring 126 situated within the socket 116 of the disc 114 a proper degree of relative swing angle θ between the foot 112 and the body 70 is provided for without contact between the retainer ring 126 and the body 70 as is illustrated in FIG. 3. As can be seen from the illustration of FIG. 3, the "nested" location of the retainer ring 126 within the socket 116 allows the lower surface of the body 70 to contact the annular land 122 of the disc 114, location "A", rather than contacting the retainer thereby increasing the durability of the retainer ring 126.

Similarly, the neck 104 of the follower body 70 may include a radially inward taper, or back taper, in the upward direction, as viewed in FIG. 3. The back taper allows the foot assembly to swing through its maximum desired angular displacement relative to the follower body 70 without contact between the radial inner end of the flange 130 defining opening 132 and the neck 104, location "B". The result of the nested configuration of the retainer ring 126 within the foot socket 116 in combination with the tapered neck 104 of the body 70 provides a retainer configuration which is substantially contact-free, relative to the lash adjuster body 70, during operation.

Taper of the actuator neck 104 has the advantage of contributing to minimized contact between the retaining ring 126 and the lash adjuster body 70 while also functioning to maintain the foot assembly 112 in place during shipping of the part when the unloaded foot assembly 112 may be allowed to hang from the enlarged actuator head 106. In such an instance the larger neck diameter adjacent the enlarged head portion 106 cooperates with opening 132 of the retaining ring 126 to prevent the foot assembly 112 from achieving sufficient lateral movement to become dislodged.

The foregoing description of the preferred embodiments of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described were chosen to provide an illustration of the principles of the invention and of its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

We claim:

1. A hydraulic lash adjuster for disposition between a rocker arm and a valve stem of an internal combustion engine comprising a body having an actuator disposed at a first end, said actuator comprising an axially extending neck terminating in an enlarged head portion, said lash adjuster further comprising a foot assembly comprising a disc member having a first surface which includes a socket and a second, flat surface, said socket configured to receive said enlarged head portion therein, and an annular retainer ring disposed in said socket said retainer ring including an axially extending cylindrical wall portion operable to establish an interference fit with said socket to fix said retainer therein, said retainer having at its upper end a radially inwardly extending flange member operable to define an opening through which said axially extending neck extends, said opening having a diameter smaller than said enlarged head portion of said actuator, said retainer operable to prevent egress of said enlarged head from said socket.

2. A hydraulic lash adjuster, as defined in claim 1, said opening defined by said inwardly extending flange member of said retainer having a diameter larger than the diameter of said actuator neck and operable to allow angular movement of said foot relative to said enlarged head portion.

3. A hydraulic lash adjuster, as defined in claim 1, said diameter of said actuator neck including an axial taper which increases from said lash adjuster body to said enlarged head portion, said axial taper operable to minimize lateral movement of said foot assembly relative to said enlarged head portion when said foot assembly is axially unsupported relative thereto.

* * * * *